United States Patent [19]

Okumura et al.

[11] Patent Number: 4,999,332

[45] Date of Patent: Mar. 12, 1991

[54] HEAT-SENSITIVE RECORDING MATERIAL

[75] Inventors: Fumio Okumura, Kunitachi; Akinori Okada, Tokyo; Kazuyoshi Kondo, Himezi, all of Japan

[73] Assignee: Mitsubishi Paper Mills, Limited, Tokyo, Japan

[21] Appl. No.: 241,849

[22] Filed: Sep. 8, 1988

[30] Foreign Application Priority Data

Sep. 8, 1987 [JP] Japan ..... 62-225665
Dec. 7, 1987 [JP] Japan ..... 62-310321
Jan. 8, 1988 [JP] Japan ..... 63-2344

[51] Int. Cl.[5] ..... B41M 5/18

[52] U.S. Cl. ..... 503/209; 503/208; 503/217; 503/221; 503/225

[58] Field of Search ..... 427/150–152; 503/216, 209, 208, 225, 217, 221

[56]. References Cited

U.S. PATENT DOCUMENTS 4,596,997 6/1986 Shinmoto ..... 503/216
4,764,500 8/1988 Araki et al. ..... 503/209

*Primary Examiner*—Bruce H. Hess
*Attorney, Agent, or Firm*—Cushman, Darby & Cushman

[57] ABSTRACT

A heat-sensitive recording material comprising a dye precursor which is colorless or light-colored in the usual state and a color developing agent capable of reacting with said dye precursor upon heating to develop a color which is a combination of compounds of the following chemical formulas (I) and (II). Said material may comprise further the compounds of the following formula (III):

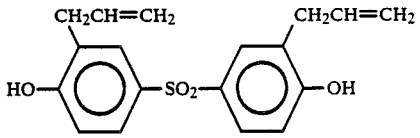

(I)

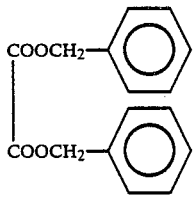

(II)

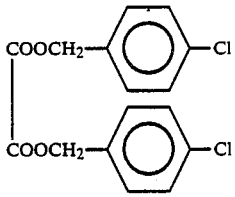

(III)

8 Claims, No Drawings

HEAT-SENSITIVE RECORDING MATERIAL

BACKGROUND OF THE INVENTION

FIELD OF THE INVENTION

This invention relates to a heat-sensitive recording material, and particularly to a heat-sensitive recording material with improved heat-responsiveness and image-storability. Further, this invention relates to a heat-sensitive recording sheet having, as its main constitutional elements, a leuco dye and a color developing agent capable of developing color from said leuco dye upon heating, and particularly to a heat-sensitive recording sheet which, can be printed at a high speed and is prevented from deteriorating in the white area and the colored area and thereby is suitable for use as an adhesive label.

DISCUSSION OF RELATED ART

A heat-sensitive recording material is generally prepared by providing, on a support, a heat-sensitive recording layer comprising an electron donative dye precursor, usually colorless or light-colored, and an electron attractive color developing agent as its main ingredients. By means of thermal head, thermal pen, laser beam or the like, it can react instantaneously to form a record image, as is disclosed in Japanese Patent Publication 43-4,160, Japanese Patent Publication 45-14,039, etc. This type of heat-sensitive recording material is advantageous in that a record can be made thereon by the use of a relatively simple apparatus, and it is utilized in extensive fields such as recorder for measurements, facsimile, printer, computer terminals, labels, automatic ticket vending machine, and the like.

Necessary characteristics of a heat-sensitive recording material include sufficient optical density and sensitivity of developed image, freeness from deterioration of color image in the lapse of time, etc. Further, with the recent elevation of the speed in recording, it is desirable to develop a high-speed recording apparatus which simultaneously requires development of a recording material capable of coping with such high a speed, or a heat-sensitive recording material so excellent in heat-responsiveness as to give a high optical density image at a low thermal energy. Further, with expansion of the use of heat-sensitive recording material, resistance to fatty compounds, i.e. storage stability in the presence of fatty substances came from pomade, hand cream and sweat on the skin, has become a necessary quality of heat-sensitive recording material. Thus, a heat-sensitive recording material sufficiently satisfying the requirements regarding heat responsiveness and image storability is desired today.

In order to obtain a color image of high optical density, there have hitherto been disclosed a variety of additives to be incorporated into the recording layer.

For example, urea, phthalic anhydride and acetanilide were disclosed in Japanese Patent Publication 43-4,160; natural and synthetic waxes such as bees wax, carnauba wax, paraffin wax and the like were disclosed in Japanese Patent Publication 48-19,231; and salicylic acid, monobenzyl phthalate and the like were disclosed in Japanese Patent Publication 49-17,748.

Further, with the aim of improving image storability, bisphenol sulfone type of color developing agents were proposed, of which one example is the use of bis(3-allyl-4-hydroxyphenyl) sulfone disclosed in Japanese Patent Application Kokai (Laid-Open) 60-208,286. Today, 2,2-bis(4-hydroxyphenyl)-propane (hereinafter sometimes referred to as "BPA") is widely used as the color developing agent of heat-sensitive papers. As compared with the heat-sensitive papers using BPA, the heat-sensitive papers using bis(3-allyl-4-hydroxyphenyl) sulfone have a much better ability to store images.

However, this type of heat-sensitive paper is not sufficiently sensitive (heat responsive). Thus, its sensitivity cannot exceed that of heat sensitive paper using BPA.

On the other hand, a heat-sensitive recording paper prepared by providing, on the surface of a support, a colorless or light-colored leuco dye as a dye precursor and a color developing agent capable of developing a color from said leuco dye upon heating is used also in the field of adhesive labels and the like. Such heat-sensitive recording papers for adhesive labels are usually printed by the use of a thermal head. As compared with the conventional ink-printing method, this method of printing is advantageous in that the apparatus is compact and the printed letters are more beautiful.

However, this type of heat sensitive recording paper has a problem that the printed area (image area) disappears when its recording layer is contacted with a plastic film containing a plasticizer such as dioctyl adipate (DOA), dioctyl phthalate (DOP) or the like.

For example, in selling uncooked foods such as meat, fish, vegetables or daily dishes in super markets, the foods are usually introduced into a plastic tray (e.g. polystyrene sheet) and wrapped with a stretchable film made of, for example, soft polyvinyl chloride. An adhesive label printed by means of weighing printer is then applied thereto. If packaged articles are exposed for sale in a superposed state and a prior heat sensitive recording paper is used as the label, the plasticizer in the wrapping film migrates into the adhesive label contacted therewith, and the printed area (image area) on the label disappears with time making sales of the articles difficult.

In order to prevent this disappearance of printed area (image area), there has been disclosed a product prepared by providing, on a support, a heat sensitive color-forming layer comprising a color-forming agent constituted of a leuco dye and a color developing agent capable of developing a color from said leuco dye upon heating, constituted of an organic acid or a phenolic compound, and providing a protective water-soluble polymer layer on said heat-sensitive color forming layer.

However, this type of heat sensitive recording material is disadvantageous in that its heat responsiveness is deteriorated by the formation of the protective layer, though its storability in the presence of plasticizer is improved.

Currently, printing machines are being improved toward elevation of printing speed and saving of electricity, and with such a tendency improvement of heat sensitive recording paper in heat responsibility is very desirable. Thus, it is an urgent problem to develop a heat sensitive recording sheet excellent in heat responsiveness which does not deteriorate in the white area and colored area.

SUMMARY OF THE INVENTION

It is an object of the present invention to provide a heat sensitive recording material with improved heat responsiveness and image storability.

It is another object of the present invention to provide a heat sensitive recording sheet with improved storability in the presence of plasticizers and improved in heat responsiveness.

The first aspect of the present invention is directed to a heat sensitive recording material having excellent heat responsiveness and image storability comprising a dye precursor which is colorless or light-colored in the ordinary state and a color developing agent capable of reacting upon heating to develop a color from said dye precursor, wherein said color developing agent is constituted of a compound having the following chemical formula (I) and a compound having the following chemical formula (II):

[I]

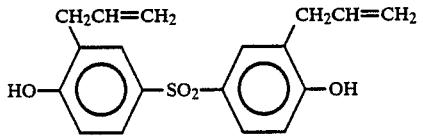

[II]

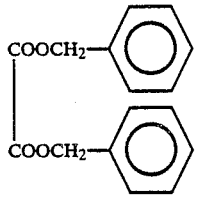

A more preferable embodiment of the first aspect, is a heat sensitive recording material comprising a compound of the following chemical formula (III) (di-p-chlorobenzyl oxalate):

[III]

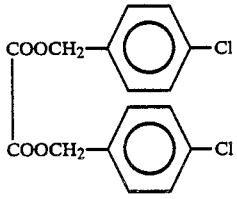

in addition to the above-mentioned compounds of chemical formulas (I) and (II).

The second aspect of the present invention is directed to a heat-sensitive recording sheet prepared by providing a heat sensitive recording layer comprising a colorless or light-colored leuco dye, a color developing agent capable of reacting with said leuco dye upon heating to develop a color and a sensitizer and providing a protective layer of a macromolecular compound (polymer) on said heat sensitive recording layer, wherein one member selected from 3-dibutylamino-6-methyl-7-anilinofluoran and 3-dibutylamino-7-o-chloroanilinofluoran is used as said leuco dye, bis-(3-allyl-4-hydroxyphenyl) sulfone which is a compound represented by the above-mentioned chemical formula (I) is used as said color developing agent, and dibenzyl oxalate which is a compound represented by the above-mentioned chemical formula (II) is used as said sensitizer.

DETAILED DESCRIPTION OF THE PREFERRED EMBODIMENTS

A heat sensitive paper using compound (II) is superior in sensitizing effect to heat sensitive papers using other hitherto known sensitizing additives (sensitizers), even when BPA is used as color developing agent. However, heat sensitive paper using compound (II) has deteriorated image storability to an extent as to be practically unusable. Further, even if a bisphenol sulfone type color developing agent is used, it has been difficult to improve image storability and realize high sensitivity exceeding that of BPA system, though the decrease in image storability can barely be prevented, unless the combination of the present invention is employed.

However, in the heat sensitive paper of the first aspect of the present invention wherein compounds (I) and (II) are used in combination, image storability. Comparable improvement has not been realized with other biphenol sulfones. Further, when compound (I) is used as color developing agent, sensitivity of the heat sensitive paper can be made higher than that of heat sensitive papers using BPA, which has been unachievable until today.

In the first aspect of the present invention, the color developing agent and the compound of chemical formula (II) are both added, usually each in an amount of 5% or more by weight, preferably 10 to 600% by weight and particularly 20 to 500% by weight, based on the weight of the dye precursor.

If the amount of each of the color developing agent and compound of formula (II) is smaller than 5% by weight, heat responsiveness and image storability are unsatisfactory. If either amount exceeds 600% by weight, the amount of thermally fusible matter deposited on thermal head, etc. increases, potentially causing trouble on the printing process. The heat responsibility can additionally be improved by adding a thermally fusible compound having a melting point of 80° to 160° C. such as stearic acid amide, N-hydroxymethylstearic acid amide and the like.

As has been mentioned above, even if a compound of chemical formula (I) is used as color developing agent, a heat sensitive paper using the compound of chemical formula (II) shows the so-called ground fogging or the coloration of ground surface due to the thermal inertia of thermal head and the like (hereinafter, referred to as "static color formation"), though it is superior to heat sensitive papers using prior sensitizing additives in sensitizing effect and image storability, and such a heat sensitive paper has been unsatisfactory from a practical point of view.

Further, if a compound of chemical formula (I) and a compound of chemical formula (III) are used in combination, heat responsibility has been unsatisfactory, though image storability and static color forming property are satisfactory.

However, if a compound of chemical formula (III) is used in combination with the compounds of chemical formulas (I) and (II), a heat sensitive recording material which is well-balanced in image storability and static color forming property can be obtained while maintaining or improving the heat responsiveness, and this has been unachievable by combining the compound of chemical formula (I) with prior sensitizing additives.

In the above-mentioned more preferable embodiment relating to the first aspect of the present invention, the compounds of chemical formulas (II) and (III) are used in the following amounts. Thus, per 40 parts by weight of the color developing agent, 10 to 30 parts by weight of compound (II) and 20 to 40 parts by weight of compound (III) are used and particularly 15 to 25 parts by weight of compound (II) and 25 to 35 parts by weight of compound (III) are used. The total amount of compound (II) and compound (III) is 40 to 55 parts by weight.

If the amount of compound (II) is smaller than 10 parts by weight, heat responsiveness is insufficient. If it exceeds 30 parts by weight, no good static color-forming property can be achieved.

If the amount of compound (III) is smaller than 20 parts by weight, static color-forming property is unsatisfactory. If it exceeds 40 parts by weight, heat responsiveness is insufficient.

The best balance between heat responsiveness image storability and static color-forming property can be realized when 15 to 25 parts by weight of compound (II) is combined with 25 to 35 parts by weight of compound (III).

According to the above-mentioned second aspect of the present invention, there can be obtained a heat sensitive recording sheet which is excellent in heat responsiveness and thus is capable of coping with high-speed and electricity-saving tendencies of printing machine, shows no coloration of ground or retains whiteness of ground even if stored at high temperature (70° C.) and has an excellent storability of colored area in the presence of plasticizer or the like, although the reason for this fact is unknown.

If the above-mentioned construction of the second aspect is altered even partially, one of the three characteristics, i.e. heat responsiveness, whiteness of ground in storage at high temperature and storability of colored area is deteriorated, and the product becomes unusable practically. This is a unique characteristic feature of the present invention.

The amount of the compounds of chemical formulas (I) and (II) used in the second aspect of the present invention are in the above-mentioned ranges, and their amounts should be particularly in the ranges suitable for using the product as a sheet.

The main ingredients used in the heat sensitive recording material of the present invention will concretely be explained below, but the examples are not intended to limit the scope of the invention.

As the dye precursor, triphenylmethane type, fluoran type, diphenylmethane type, thaizine type and spiropyran type of compounds and the like can be referred to. Their examples include Crystal Violet Lactone, 3-diethylamino-7-methylfluoran, 3-diethylamino-6-chloro-7-methylfluoran, 3-diethylamino-6-methyl-7-chlorofluoran, 3-diethylamino-7-anilinofluoran, 3-diethylamino-7-(2-chloroanilino)-fluoran, 3-dibutylamino-7-(2-chloroanilino)-fluoran, 3-diethylamino-7-(3-chloroanilino)-fluoran, 3-diethylamino-6-methyl-7-anilinofluoran, 3-(N-ethyl-p-toluidino)-6-methyl-7-anilinofluoran, 3-(N-methylcyclo-hexylamino)-3-methyl-7-anilinofluoran, 3-piperidino-3-methyl-7-anilinofluoran, 3-dibutylamino-6-methyl-7anilinofluoran, 3-(N-methyl-N-propyl)-amino-6-methyl-7-anilinofluoran, 3-(N-ethyl-N-isopropyl)-amino-6-methyl-7anilinofluoran, 3-(N-ethyl-N-tetrahydrofurfuryl)-amino-6-methyl-7-anilinofluoran, and the like.

Among the above-mentioned dye precursors, the leuco dyes which can be used in the second aspect of the present invention include 3-dibutylamino-6-methyl-7-anilinofluoran and 3-dibutylamino-7-o-chloroanilinofluoran.

The binders usable in the invention include water-soluble binders such as starches, hydroxyethyl cellulose, methyl cellulose, carboxymethyl cellulose, gelatin, casein, polyvinyl alcohol, modified polyvinyl alcohol, styrene-maleic anhydride copolymer, ethylene-maleic anhydride copolymer and the like, and latex type water-insoluble binders such as styrene-butadiene copolymer, acrylonitrile-butadiene copolymer, methyl acrylate-butadiene copolymer and the like.

The pigments usable in the invention include diatomaceous earth, talc, kaolinite, fired kaolinite, calcium carbonate, magnesium carbonate, titanium oxide, zinc oxide, silicon oxide, aluminum hydroxide, ureaformaldehyde resin and the like.

In addition to above, the following additives may be added for the purpose of preventing the wear of head and preventing sticking: metallic salts of higher fatty acids such as zinc stearate, calcium stearate and the like; waxes such as paraffin, oxidized paraffin, polyethylene, oxidized polyethylene, stearic acid amide, caster wax and the like; dispersants such as sodium dioctyl sulfosuccinate and the like; ultraviolet absorbers such as benzophenone compounds, benzotriazole compounds and the like; surfactants; fluorescent dyes; and the like.

In the heat sensitive recording material of the invention, paper is mainly used as the support. Instead of paper, however, various unwoven fabrics, plastic films, synthetic papers, metallic foils and the like or composite sheets prepared by combining these materials may also be used arbitrarily.

In the second aspect of the invention, an undercoat layer may be provided between the heat sensitive color-forming layer and the support, if desired.

As the protective layer used in the second aspect of the invention, water-soluble polymers are generally preferred. That is, single substance or combination of two or more substances selected from polymers such as alginic acid salts, hydroxyethyl cellulose, methyl cellulose, carboxymethyl cellulose and polyvinyl alcohol is preferable.

Further, introduction of film-forming polymer emulsion such as acryl type latex, vinyl type acrylic resin, vinyl acetate-ethylene copolymer, silicone-acrylate resin, styrene-butadiene type latex and the like is also attempted, and its result is successful.

Further, in a preferable embodiment, one or more kind(s) of water-proofing agent, ultraviolet absorber and demolding agent are used in combination to give the product water resistance and light resistance and to prevent the peeling of film (blocking) due to adhesion.

Further, an adhesive layer covered with a peelable mount may be provided on the backside of the support in the usual way for the purpose of making it possible to apply the product onto a solid surface such as wrap film, packaging paper or the like. Further, a barrier layer may be provided between the adhesive layer and the support to prevent the migration of plasticizer and the like.

Next, the present invention will be illustrated by way of the following examples. Needless to say, the invention is by no means limited by these examples.

EXAMPLE 1

Ten grams of 3-dibutylamino-6-methyl-7-anilinofluoran were dispersed for 24 hours by means of ball mill together with 30 g of 2% aqueous solution of polyvinyl alcohol.

Twenty five g of the compound of chemical formula (I) were dispersed for 24 hours by means of ball mill together with 75 g of 2% aqueous solution of polyvinyl alcohol. Further, 25 g of the compound of chemical formula (II) were dispersed for 24 hours by means of ball mill together with 75 g of 2% aqueous solution of polyvinyl alcohol.

The above-mentioned three dispersions were mixed together, to which were successively added 80 g of a 50% dispersion of calcium carbonate, 25 g of a 20% dispersion of zinc stearate and 200 g of 10% aqueous solution of polyvinyl alcohol. The resulting mixture was thoroughly stirred to prepare a coating fluid.

The coating fluid was applied to a base paper having a basis weight of 55 g/m$^2$ so that the amount of coating (solid) came to 4.0 g/m$^2$, after which it was dried and treated with super calender to prepare a heat sensitive recording material.

COMPARATIVE EXAMPLE 1

A heat sensitive recording material was prepared by repeating the procedure of Example 1, except that the compound of chemical formula (I) used in Example 1 was replaced with 2,2-bis(4-hydroxyphenyl)-propane.

COMPARATIVE EXAMPLE 2

A heat sensitive recording material was prepared by repeating the procedure of Example 1, except that the compound of chemical formula (II) was replaced with 2-benzyloxynaphthalene.

COMPARATIVE EXAMPLE 3

A heat sensitive recording material was prepared by repeating the procedure of Example 1, except that the compound of chemical formula (II) was replaced with p-benzyldiphenyl.

COMPARATIVE EXAMPLE 4

A heat sensitive recording material was prepared by repeating the procedure of Example 1, except that the compound of chemical formula (I) was replaced with 4-hydroxy-4'-isopropyloxydiphenyl sulfone.

The heat sensitive recording materials obtained above were recorded by means of heat sensitive paper long distance abrasion tester (manufactured by Matsushita Denshi Buhin K. K.), and the optical density of formed image was measured by means of Macbeth densitometer.

Further, heat resistance of record area was also tested. The results are shown in Table 1.

TABLE 1

| | Optical density of formed image | Percentage of residual image after heat resistance test (%) |
|---|---|---|
| Example 1 | 1.12 | 90 |
| Comparative Example 1 | 1.00 | 17 |
| Comparative Example 2 | 0.88 | 67 |
| Comparative Example 3 | 0.85 | 65 |
| Comparative Example 4 | 0.96 | 60 |

Heat resistance test: After allowing the recorded sample to stand in a thermostatted room (60° C.) for 24 hours, the optical density of image was measured by means of Macbeth densitometer.

It is apparent from Table 1 that the heat sensitive recording material of Example 1, (the first aspect of the invention) is superior to that of Comparative Example 1 to 4 in heat responsibility and image stability.

EXAMPLE 2

Thirty grams of 3-dibutylamino-6-methyl-7-anilinofluoran were dispersed by means of paint conditioner together with 70 g of water containing 1.5 g of polyvinyl alcohol. Forty g of the compound of chemical formula (I) were dispersed by means of paint conditioner together with 60 g of water containing 2 g of polyvinyl alcohol. Further, 15 g of the compound of chemical formula (II) were dispersed together with 50 g of water containing 0.75 g of polyvinyl alcohol. Further, 35 g of the compound of chemical formula (III) were dispersed together with 117 g of water containing 1.75 g of polyvinyl alcohol.

After mixing together these four dispersions, 75 g of 40% dispersion of calcium carbonate, 25 g of 40% dispersion of zinc stearate, 160 g of 10% aqueous solution of polyvinyl alcohol and 170 g of water were successively added, and the resulting mixture was thoroughly stirred to prepare a coating fluid.

A stirred mixture consisting of 100 g of fired kaolinite and 200 g of 10% aqueous solution of polyvinyl alcohol was applied onto a base paper having a basis weight of 42 g/m$^2$ so that the amount of coating came to 5 g/m$^2$ after dryness, after which it was dried to prepare a support.

The support thus obtained was coated with the above-mentioned coating fluid and dried, so that the amount of coating (solid) came to 4.0 g/m$^2$. It was treated with super calender to prepare a heat sensitive recording material.

EXAMPLE 3

A heat sensitive recording material was prepared by repeating the procedure of Example 2, except that the compound of chemical formula (II) was used in an amount of 20 g and the compound of chemical formula (III) was used in an amount of 20 g.

EXAMPLE 4

A heat sensitive recording material was prepared by repeating the procedure of Example 2, except that the compound of chemical formula (II) was used in an amount of 15 g and the compound of chemical formula (III) was used in an amount of 30 g.

EXAMPLE 5

A heat sensitive recording material was prepared by repeating the procedure of Example 2, except that the compound of chemical formula (II) was used alone in stead of using the combination of compounds (II) and (III).

COMPARATIVE EXAMPLE 5

A heat sensitive recording material was prepared by repeating the procedure of Example 2, except that the compound of chemical formula (III) was used alone in stead of using the combination of compounds (II) and (III).

COMPARATIVE EXAMPLE 6

A heat sensitive recording material was prepared by repeating the procedure of Example 2, except that the compound of chemical formula (I) used in Example 2 was replaced with Bisphenol A and the combination of compounds (II) and (III) was replaced with 2-benzyloxynaphthalene.

(Evaluation)

The heat sensitive recording materials obtained in Examples 2 to 4 Example 5 and Comparative Examples 5 to 6 were printed by means of G3FAX testing machine and the optical densities of the images formed thereon were compared. The testing machine was TH-PMD manufactured by Okura Denki K. K., and its dot density was 8 dots/mm. The thermal head had a head resistance of 185 Ω. The head voltage was 11 V, and electricity was carried for 0.5 ms. The optical density of image was measured with Macbeth RD-514 reflection densitometer. Further, printed samples were allowed to stand in a thermostatted room (60° C.) for 24 hours, and then percentage of residual image (%) was measured.

The percentage of residual image was calculated according to the following equation:

$$\text{Percentage of residual image (\%)} = \frac{\text{Optical density of image part after the treatment}}{\text{Optical density of image part before the treatment}} \times 100$$

Static color-forming property was evaluated by tightly contacting a thermal block having a temperature of 85° C. with a heat sensitive paper under a load of 200 g/cm$^2$ for a period of 3 seconds and measuring the optical density of colored area. In this test, a smaller numerical value means a smaller extent of ground fogging due to thermal inertia of head.

TABLE 2

| | Example 2 | Example 3 | Example 4 | Example 5 | Comparative Example 5 | Comparative Example 6 |
|---|---|---|---|---|---|---|
| Optical density of image | 0.81 | 0.96 | 0.78 | 1.04 | 0.55 | 0.75 |
| Percentage of residual image (%) | 95 | 94 | 95 | 95 | 95 | 17 |
| Static color-forming property | 0.40 | 0.68 | 0.32 | 1.15 | 0.20 | 0.38 |

It is apparent from Table 2 that the combinations according to the present invention are superior to the combinations of Comparative Example 5 to 6 in the practical static color forming property, while maintaining high sensitivity and storability.

EXAMPLE 6

Fluid A and fluid B were prepared by pulverizing and dispersing the mixtures of the following formulations by means of ball mill until the mean particle diameter reached 1 to 3 μm:

| | | parts by wt. |
|---|---|---|
| Fluid A: | 3-Dibutylamino-6-methyl-7-anilinofluoran | 1 |
| | 10% solution of polyvinyl alcohol | 1.5 |
| | Water | 2.5 |
| Fluid B: | Bis-(3-allyl-4-hydroxyphenyl) sulfone | 2 |
| | Dibenzyl oxalate | 2 |
| | Calcium carbonate | 3 |
| | 10% solution of polyvinyl alcohol | 10.5 |
| | Water | 17.5 |

By mixing together fluids A and B, a coating fluid was prepared. The coating fluid was applied to one side of a high quality paper having a basis weight of 50 g/m$^2$ and dried to form a heat sensitive color-forming layer having a coating weight of 5 g/m$^2$. Then, it was calendered so that the Bekk smoothness reached 100 seconds or more, to prepare a heat sensitive recording paper.

Onto the heat sensitive color-forming layer of the heat sensitive recording paper obtained above, a protective layer-forming fluid (Fluid C) having the following formulation:

| | | parts by wt. |
|---|---|---|
| Fluid C: | 10% solution of polyvinyl alcohol | 10 |
| | 20% acrylic resin | 5 |
| | 30% zinc stearate | 2 |

was coated and dried to form a protective layer having a coating weight of 3 g/m$^2$ and calendered so that Bekk smoothness reached 300 seconds or more. Then, onto the backside of this heat sensitive recording paper, a silicone resin-coated peelable paper having an acrylic adhesive layer (coating weight 20 g/m$^2$) on its silicone resin surface was applied through intermediation of the adhesive layer. Then, the whole was cut into an appropriate size to obtain a heat sensitive adhesive label.

EXAMPLE 7

A heat sensitive adhesive label was prepared by repeating the procedure of Example 6, except that the dye 3-dibutylamino-6-methyl-7-anilinofluoran used in Example 6 was replaced with 3-dibutylamino-7-o-chloroanilinofluoran.

COMPARATIVE EXAMPLE 7

A heat sensitive adhesive label was prepared by repeating the procedure of Example 6, except that the dye 3-dibutylamino-6-methyl-7-anilinofluoran used in Example 6 was replaced with 3-(N-methyl-N-cyclohexylamino)-6-methyl-7-anilinofluoran.

COMPARATIVE EXAMPLE 8

A heat sensitive adhesive label was prepared by repeating the procedure of Example 6, except that the dye 3-dibutylamino-6-methyl-7-anilinofluoran used in Example 6 was replaced with 3-diethylamino-6-methyl-7-anilinofluoran.

COMPARATIVE EXAMPLE 9

A heat sensitive adhesive label was prepared by repeating the procedure of Example 6, except that the dye 3-dibutylamino-6-methyl-7-anilinofluoran used in Example 6 was replaced with 3-(N-ethyl-N-isopentyl)-amino-6-methyl-7-anilinofluoran.

COMPARATIVE EXAMPLE 10

A heat sensitive adhesive label was prepared by repeating the procedure of Example 6, except that the color developing agent bis-(3-allyl-4-hydroxyphenyl) sulfone used in Example 6 was replaced with Bisphenol A.

COMPARATIVE EXAMPLE 11

A heat sensitive adhesive label was prepared by repeating the procedure of Example 7, except that the color developing agent bis-(3-allyl-4-hydroxyphenyl) sulfone used in Example 7 was replaced with Bisphenol A.

COMPARATIVE EXAMPLE 12

A heat sensitive adhesive label was prepared by repeating the procedure of Example 6, except that the sensitizer dibenzyl oxalate used in Example 6 was replaced with stearic acid amide.

COMPARATIVE EXAMPLE 13

A heat sensitive adhesive label was prepared by repeating the procedure of Example 6, except that the sensitizer dibenzyl oxalate used in Example 7 was replaced with stearic acid amide.

The nine heat sensitive adhesive labels obtained above were examined for heat responsiveness, ground fogging and plasticizer resistance.

(1) Heat responsiveness

Using printing machine TH-PMD (manufactured by Okura Denki K. K.), sample was printed at varied printing energy, and optical density of formed image was measured with Macbeth densitometer RD-514. A greater numerical value means a better result.

(2) Ground fogging

After allowing sample to stand at 70° C. for 24 hours, optical density of the ground was measured. A smaller numerical value means a better result.

(3) Plasticizer resistance

After printing sample by means of digital scale D-805P (manufactured by Ishida Koki Seisakusho K. K.), a polyvinyl chloride wrap was superposed thereon and allowed to stand under load at 40° C. for 24 hours. Then, optical density was measured and plasticizer resistance was calculated therefrom according to the following formula:

$$\frac{\text{(Optical density after standing)}}{\text{(Optical density before standing)}} \times 100$$

A greater numerical value means a better result.

TABLE 3

| | Heat responsiveness/ Applied energy[1] | | | Judgement | Ground fogging | Judgement | Plasticizer resistance (%) | Judgement | Overall Judgement |
|---|---|---|---|---|---|---|---|---|---|
| | 0.35 | 0.47 | 0.59 | | | | | | |
| Example 6 | 0.73 | 1.16 | 1.30 | O | 0.20 | O | 98 | O | O |
| Example 7 | 0.82 | 1.19 | 1.29 | O | 0.13 | O | 95 | O | O |
| Comparative Example 8 | 0.75 | 1.16 | 1.29 | O | 0.37 | X | 99 | O | X |
| Comparative Example 8 | 0.75 | 1.13 | 1.28 | O | 0.56 | X | 99 | O | X |
| Comparative Example 9 | 0.75 | 1.17 | 1.30 | O | 0.63 | X | 99 | O | X |
| Comparative Example 10 | 0.85 | 1.20 | 1.31 | O | 0.30 | X | 51 | X | X |
| Comparative Example 11 | 0.87 | 1.20 | 1.33 | O | 0.15 | O | 45 | X | X |
| Comparative Example 12 | 0.52 | 0.90 | 1.13 | X | 0.15 | O | 93 | O | X |
| Comparative Example 13 | 0.55 | 0.93 | 1.17 | X | 0.10 | O | 91 | O | X |

[1]Applied energy: unit mj/dot

It is apparent from Table 3 that the heat sensitive adhesive label according to the second aspect, of the present invention is improved in heat responsiveness, lessened in the extent of ground fogging and excellent in plasticizer resistance.

What is claimed is:

1. A heat sensitive recording material comprising a dye precursor which is colorless or light-colored in the usual state, a compound of the following chemical formula (I) as a color developing agent which reacts with said dye precursor upon heating to develop a color, and a compound of the following chemical formula (II) as a sensitizer:

[I]

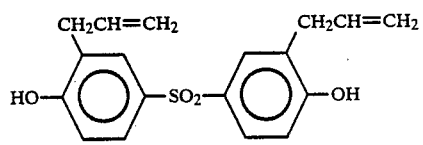

[II]

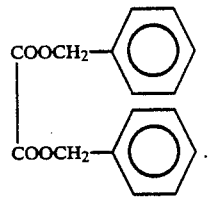

2. A heat sensitive recording material according to claim 1, wherein the amount of the compound of chemical formula (I) and the amount of the compound of chemical formula (II) are each 5% or more by weight based on the weight of said dye precursor.

3. A heat sensitive recording material according to claim 1 which additionally comprises a compound of the following chemical formula (III):

[III]

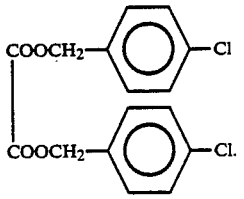

4. A heat sensitive recording material according to claim 3, wherein the amount of the compound of chemical formula (II) is 10 to 30 parts by weight, the amount of the compound of chemical formula (III) is 20 to 40 parts by weight, both per 40 parts by weight of the color developing agent of chemical formula (I), and the total amount of the compounds of chemical formulas (II) and (III) is 30 to 70 parts by weight on the same basis as above.

5. A heat sensitive recording material according to claim 1, wherein said recording material is a heat sensitive recording sheet prepared by providing, on a support, a heat sensitive recording layer comprising a colorless or light-colored leuco dye as a dye precursor, a color developing agent capable of reacting with said leuco dye upon heating to develop a color and a sensitizer and providing a protective layer of a polymer on said heat sensitive recording layer, and one member selected from 3-dibutylamino-6-methyl-7-anilinofluoran and 3-dibutylamino-7-o-chloroanilinofluoran is used as said leuco dye, bis(3-allyl-4-hydroxyphenyl) sulfone (the compound of chemical formula (I)) is used as said color developing agent, and dibenzyl oxalate (the compound of chemical formula (II)) is used as said sensitizer.

6. A heat sensitive recording material according to claim 5, wherein an undercoat layer is provided between said heat sensitive color forming layer and said support.

7. A heat sensitive recording material according to claim 5, wherein said polymer as a protective layer is a water-soluble polymer.

8. A heat sensitive recording material according to claim 5, further comprising at least one member selected from the group consisting of a waterproofing agent, ultraviolet absorber and demolding agent.

* * * * *